US009095012B2

(12) United States Patent
Cai

(10) Patent No.: US 9,095,012 B2
(45) Date of Patent: Jul. 28, 2015

(54) VARIABLE ENERGY LAMP CONTROL CIRCUIT AND VARIABLE ENERGY LAMP CONTROL PANEL

(75) Inventor: Mingfang Cai, Shenzhen (CN)

(73) Assignee: SHENZHEN HONGGUANGCHENG INDUSTRY CO., LTD., Shenzhen (CN)

( * ) Notice: Subject to any disclaimer, the term of this patent is extended or adjusted under 35 U.S.C. 154(b) by 23 days.

(21) Appl. No.: 14/344,607

(22) PCT Filed: Mar. 13, 2012

(86) PCT No.: PCT/CN2012/072249

§ 371 (c)(1), (2), (4) Date: Mar. 13, 2014

(87) PCT Pub. No.: WO2013/040876

PCT Pub. Date: Mar. 28, 2013

(65) Prior Publication Data

US 2015/0002016 A1 Jan. 1, 2015

(30) Foreign Application Priority Data

Sep. 21, 2011 (CN) ..... 2011 1 0282016

(51) Int. Cl.

| | |
|---|---|
| ***H05B 37/02*** | (2006.01) |
| ***H05B 39/02*** | (2006.01) |
| ***H05B 37/03*** | (2006.01) |

(52) U.S. Cl.

CPC ..... *H05B 37/0209* (2013.01); *H05B 37/0227* (2013.01); *H05B 37/03* (2013.01)

(58) Field of Classification Search

CPC . H05B 37/0209; H05B 37/03; H05B 37/0227
USPC ..... 315/86, 287, 307, 308
See application file for complete search history.

(56) References Cited

U.S. PATENT DOCUMENTS

2014/0049181 A1* 2/2014 Kelly et al. ..... 315/224

* cited by examiner

*Primary Examiner* — Daniel D Chang

(57) ABSTRACT

The present disclosure provides a variable energy lamp control circuit, including a power supply management circuit, an alternating current detection and high-frequency signal transmission circuit, a manual switch, a high-frequency signal receiving circuit, a delay circuit working power input control circuit, a work delay circuit, an alternating current sensing circuit, a control signal conversion circuit, and a driving circuit. The control signal conversion circuit is configured for controlling on and off of the variable energy lamp via the driving circuit according to a first control signal outputted from a first control signal output terminal of the alternating current detection and high-frequency signal transmission circuit, a second control signal outputted from an output terminal of the alternating current sensing circuit, and a third control signal outputted form a third control signal output terminal of the work delay circuit.

20 Claims, 6 Drawing Sheets

VARIABLE ENERGY LAMP CONTROL CIRCUIT AND VARIABLE ENERGY LAMP CONTROL PANEL

BACKGROUND

1. Technical Field

The present disclosure generally relates to variable energy lamps, and more particularly, relates to a variable energy lamp control circuit and a variable energy lamp control panel used in office lighting, home lighting, and emergency lighting.

2. Description of Related Art

At present, in a variable energy lamp control circuit, the variable energy lamp still can be turned on when one of a live wire and a neutral wire of the circuit is not provided with an alternating current signal. However, after the variable energy lamp is turned on, the variable energy lamp cannot be turned off manually according to actual requirements. In addition, the turned-on time the variable energy lamp cannot be controlled when the circuit is provided with an alternating current and the variable energy lamp is turned off, that is, when an alternating current is present in the circuit and the variable energy lamp is turned off, the variable energy lamp cannot be controlled to be turned off automatically after having been on for a certain time. In this case, the variable energy lamp is prevented from being used in emergency lighting when the lighting lamp is turned off before people go to bed at night.

SUMMARY

The main object of the present disclosure is to provide a variable energy lamp control circuit and a variable energy lamp control panel, which allows the variable energy lamp to be applicable in ordinary lighting and emergency lighting and to be used as an early-warning light, and is capable of controlling on and off of the variable energy lamp via a manual switch.

The variable energy lamp control circuit includes a power supply management circuit, an alternating current detection and high-frequency signal transmission circuit, a manual switch, a high-frequency signal receiving circuit, a delay circuit working power input control circuit, a work delay circuit, an alternating current sensing circuit, a control signal conversion circuit, and a driving circuit;

the power supply management circuit is configured for selecting a way that power is supplied to the variable energy lamp control circuit;

the alternating current detection and high-frequency signal transmission circuit is configured for detecting an outer alternating current signal and transmitting a high-frequency signal according to the alternating current signal;

the high-frequency signal receiving circuit is configured for receiving the high-frequency signal transmitted by the alternating current detection and high-frequency signal transmission circuit when the manual switch is closed;

the alternating current sensing circuit is configured for sensing the outer alternating current signal and outputting a sensing result to the control signal conversion circuit;

the delay circuit working power input control circuit is configured for controlling an input of a working power of the work delay circuit;

the work delay circuit is configured for controlling a delay time of a variable energy lamp from on to off when an alternating current is present in the variable energy lamp control circuit and an illuminating lamp is turned off; and the control signal conversion circuit is configured for controlling on and off of the variable energy lamp via the driving circuit according to whether the circuit is powered on or powered off and whether the manual switch is closed or open and according to the sensing result from the alternating current sensing circuit.

Preferably, when an alternating current is present in the variable energy lamp control circuit and the illuminating lamp is off, the delay circuit working power input control circuit supplies a working power of 3.3 volts to the work delay circuit, thus the work delay circuit works; when an alternating current is present in the variable energy lamp control circuit and the illuminating lamp is on, the delay circuit working power input control circuit does not supply the working power of 3.3 volts to the work delay circuit, thus the work delay circuit does not work.

Preferably, the power supply management circuit includes a first switching power supply input terminal, a first rechargeable battery power supply input terminal, a battery charging management chip, a working power output terminal, a first linear voltage regulator, a first diode, a second diode, a plurality of resistors and a plurality of capacitors; the first switching power supply input terminal is connected to a power input pin of the battery charging management chip and a power input pin of the first linear voltage regulator through the first diode; the first rechargeable battery power supply terminal is connected to the power input pin of the first linear voltage regulator through the second diode and is grounded through two parallel capacitors; a power output pin of the first linear voltage regulator is connected to the working power output terminal; a cathode of the first diode is grounded through a capacitor and is connected to a charging state indication pin of the battery charging management chip through a resistor; and a charging current setting pin of the battery charging management chip is grounded through a resistor.

Preferably, the alternating current detection and high-frequency signal transmission circuit includes a first working power input terminal, an alternating current detection and high-frequency transmission chip, a first RC network, a correction chip, a third diode, a first control signal output terminal, and a plurality of resistors and a plurality of capacitors; the first working power input terminal is connected to the working power output terminal of the power supply management circuit; a working power input pin of the alternating current detection and high-frequency transmission chip is connected to the first working power input terminal, a high-frequency signal output pin thereof is respectively connected to a live wire and a neutral wire through a resistor and a capacitor; the first RC network is connected between the high-frequency signal output pin and an alternating current detection pin of the alternating current detection and high-frequency transmission chip, a modulating signal output pin of the alternating current detection and high-frequency transmission chip is connected to a correction signal input pin of the correction chip; a power input pin of the correction chip is connected to the first working input terminal and the correction signal output pin of the correction chip is connected to the first control signal output terminal through a resistor and the third diode.

Preferably, the high-frequency signal receiving circuit includes a second working power input terminal, a high-frequency signal receiving chip, a second RC network, a sampling RC network a fourth diode, and several resistors and capacitors; the second working power input terminal is connected to the working power output terminal of the power supply management circuit; high-frequency signal input pins of the high-frequency signal receiving chip are respectively connected to the live wire and the neutral wire through the second RC network and a manual switch; a sampling RC network input pin of the high-frequency signal receiving chip is connected to the sampling RC network, and a detection output pin of the high-frequency signal receiving chip is connected to the correction signal input pin of the correction chip through the fourth diode.

Preferably, the delay circuit working power input control circuit includes a second switching power supply input terminal, a second rechargeable battery power supply input terminal, a 3.3-volt working power output terminal, a first N-channel metal-oxide-semiconductor (MOS) transistor, a second linear voltage regulator, a first capacitor, a second capacitor, and several resistors; a power input pin of the second linear voltage regulator is connected to the rechargeable battery power supply input terminal, an enable pin thereof is connected to the second rechargeable battery power supply input terminal through a resistor, a power output pin thereof is connected to the 3.3-volt working power output terminal and is grounded through the first capacitor and the second capacitor parallel with the first capacitor; a drain of the first N-channel MOS transistor is connected to the enable pin of the second linear voltage regulator, a gate thereof is connected to the second switching power supply input terminal through a resistor and is connected to a source thereof through a resistor, and the source thereof is grounded and is connected to the enable pin of the second linear voltage regulator through a resistor.

Preferably, the work delay circuit includes a third switching power supply input terminal, a NE 555 clock timing chip, a 3.3-volt working power input terminal, a fifth diode, a sixth diode, a seventh diode, a third capacitor, a fourth capacitor, a third control signal output terminal, and a plurality of resistors; the 3.3-volt working power input terminal is connected to the 3.3-volt working power output terminal, the third switching power supply input terminal is connected to the third control signal output terminal through the fifth diode and a resistor and is connected to a cathode of the sixth diode; an anode of the sixth diode is connected to a third pin of the NE 555 clock timing chip and is connected to a cathode of the seventh diode; an anode of the seventh diode is grounded; the 3.3-volt working power input terminal is connected to a fourth pin and an eighth pin of the NE 555 clock timing chip; the fourth pin of the NE 555 clock timing chip is connected to the second pin thereof through the third capacitor, a sixth pin thereof is connected to the second pin thereof and is grounded through a resistor, and a fifth pin thereof is grounded through the fourth capacitor.

Preferably, the control signal conversion circuit includes a first control signal input terminal, a second control signal input terminal, a third control signal input terminal, a two-input AND chip, an eighth diode, a second N-channel MOS transistor, and a control signal output terminal; the two-input AND chip includes a first input terminal and a second input terminal; the first control signal input terminal is connected to a gate of the second N-channel MOS transistor, the second control signal input terminal is connected to an output terminal of the alternating current sensing circuit and is connected to the first input terminal of the two-input AND chip; the third control signal input terminal is connected to the second input terminal of the two-input AND chip; an output terminal of the two-input AND chip is connected to an anode of the eighth diode, and a cathode of the eighth diode is connected to the gate of the second N-channel MOS transistor; a source of the second N-channel MOS transistor is grounded, and a drain thereof is connected to the control signal output terminal.

Preferably, the driving circuit includes a rechargeable battery power supply input terminal, a driving chip, a ninth diode, an inductor, and several resistors and several capacitors; the variable energy lamp is connected to the driving circuit; an enable pin of the driving chip is connected to the control signal output terminal of the control signal conversion circuit; the rechargeable battery power supply input terminal is connected to an anode of the ninth diode through the inductor, and a cathode of the ninth diode is connected to an anode of the at least one variable energy lamp; a driving output terminal of the driving chip is connected to the anode of the at least one variable energy lamp through the ninth diode, and a cathode of the at least one variable energy lamp is grounded.

Preferably, the alternating current sensing circuit includes a sensor for sensing the outer alternating current signal.

The present disclosure further provides a variable energy lamp control panel, including a variable energy lamp control circuit which includes a power supply management circuit, an alternating current detection and high-frequency signal transmission circuit, a manual switch, a high-frequency signal receiving circuit, a delay circuit working power input control circuit, a work delay circuit, an alternating current sensing circuit, a control signal conversion circuit, and a driving circuit;

the power supply management circuit is configured for selecting a way that power is supplied to the variable energy lamp control circuit;

the alternating current detection and high-frequency signal transmission circuit is configured for detecting an outer alternating current signal and transmitting a high-frequency signal according to the alternating current signal;

the high-frequency signal receiving circuit is configured for receiving the high-frequency signal transmitted by the alternating current detection and high-frequency signal transmission circuit when the manual switch is closed;

the alternating current sensing circuit is configured for sensing the outer alternating current signal and outputting a sensing result to the control signal conversion circuit;

the delay circuit working power input control circuit is configured for controlling an input of a working power of the work delay circuit;

the work delay circuit is configured for controlling a delay time of a variable energy lamp from on to off when an alternating current is present in the variable energy lamp control circuit and an illuminating lamp is turned off; and the control signal conversion circuit is configured for controlling the on and off of the variable energy lamp via the driving circuit according to whether the variable energy lamp control circuit is powered on or powered off and according to whether the manual switch is closed or open and according to the sensing result from the alternating current sensing circuit.

The variable energy lamp control circuit of the present disclosure is capable of controlling the on and off the corresponding variable energy lamp according to the sensing of the outer alternating current signal, the high-frequency signal received by the high-frequency signal receiving circuit, and the working situation of the work delay circuit. When an alternating current is present in the circuit and the illuminating lamp is turned on, the variable energy lamp control circuit is capable of controlling the variable energy lamp to be in an off state; when an alternating current is present in the circuit and the illuminating lamp is turned off, or when no alternating current is present in the circuit, the variable energy lamp control circuit is capable of controlling the variable energy lamp to be in an on state; furthermore, when an alternating current is present in the circuit and the illuminating lamp is turned on, the variable energy lamp control circuit is capable of controlling the variable energy lamp to be in an on state for a predetermined time and thereafter to be in an off state, for realizing emergency lighting; meanwhile, when no alternating current is present in the circuit, the variable energy lamp control circuit of the present disclosure is capable of controlling the on and off the variable energy lamp by the manual switch, allowing the variable energy lamp of the present disclosure to be applicable in ordinary lighting and emergency lighting and to be used as an early-warning light.

DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment is this disclosure are not necessarily to the same embodiment, and such references mean at least one.

Figure 1:
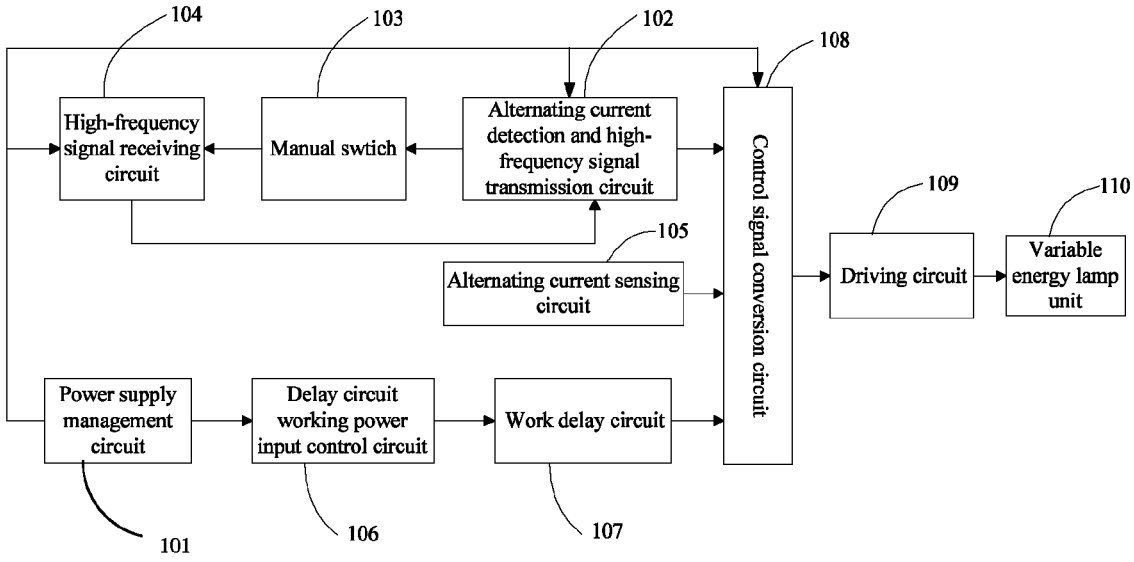
FIG. 1 is a schematic block diagram of a variable energy lamp control circuit in accordance with an embodiment of the present disclosure.

Referring to FIG. 1, which is a schematic block diagram of a variable energy lamp control circuit in accordance with an embodiment of the present disclosure, the variable energy lamp control circuit includes a power supply management circuit 101, an alternating current detection and high-frequency signal transmission circuit 102, a manual switch 103, a high-frequency signal receiving circuit 104, an alternating current sensing circuit 105, a delay circuit working power input control circuit 106, a work delay circuit 107, a control signal conversion circuit 108, a driving circuit 109, and a variable energy lamp unit 110.

Specifically, the power supply management circuit 101 is configured for selecting the way that power is supplied to the variable energy lamp control circuit. The alternating current detection and high-frequency signal transmission circuit 102 is configured for detecting an alternating current signal in the circuit and for transmitting a high-frequency signal according to the detecting result of the alternating current signal. The high-frequency signal receiving circuit 104 is configured for receiving the high-frequency signal transmitted by the alternating current signal detection and high-frequency signal transmission circuit 102. The alternating current sensing circuit 105 is configured for sensing the alternating current signal in the circuit. The delay circuit working power input control circuit 106 is configured for controlling an input of a working power of the work delay circuit 107. When an alternating current is present in the circuit and an illuminating lamp is turned off, the delay circuit working power input control circuit 106 supplies a working power of 3.3 volts to the work delay circuit 107, and the work delay circuit 107 works; when an alternating current is present in the circuit and the illuminating lamp is turned off, the delay circuit working power input control circuit 106 is incapable of supplying a working power of 3.3 volts to the work delay circuit 107 and thus the work delay circuit 107 does not work. The work delay circuit 107 is configured for controlling a delay time of the variable energy lamp from on to off when an alternating current is present in the circuit and the illuminating lamp is turned off. The control signal conversion circuit 108 is configured for controlling the on and off of each variable energy lamp of the variable energy lamp unit 110 via the driving circuit 109 according to whether the circuit is powered on or powered off and whether the manual switch 103 is open or closed and according to the working situation of the variable energy working delay circuit 107.

The power supply management circuit 101 can supply power to the circuit via a switching power or a rechargeable battery. The alternating current sensing circuit 105 is a sensor which can be made of copper foil, copper sheet, PCB pad, or other metallic material in the embodiment for sensing the alternating current signal in the circuit.

Figure 2:
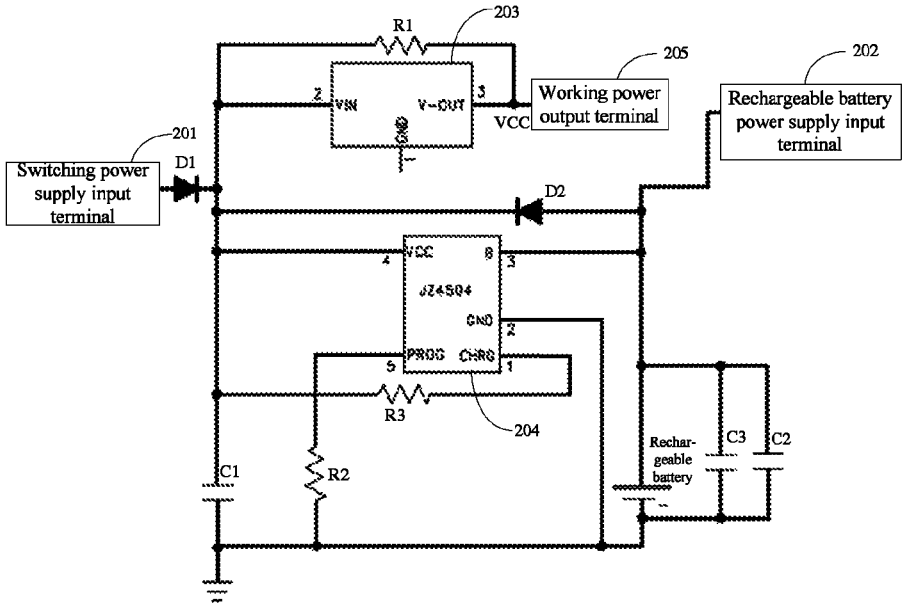
FIG. 2 is a schematic view of a power supply management circuit of the variable energy lamp control circuit in accordance with an embodiment of the present disclosure.

Referring to FIG. 2, which is a schematic view of the power supply management circuit in accordance with an embodiment of the present disclosure, the power supply management circuit includes a switching power supply input terminal 201, a rechargeable battery power supply input terminal 202, a first linear voltage regulator 203, a battery charging management chip 204, a working power output terminal 205, a first diode D1, a second diode D2, capacitors C1, C2, and C3, and resistors R1, R2, and R3. In the embodiment the model of the battery charging management chip 204 is JZ4504.

Specifically, the switching power supply input terminal 201 is connected to a power input pin of the battery charging management chip 204 through the first diode D1 and is also connected to a power input pin of the first linear voltage regulator 203. The rechargeable battery power supply input terminal 202 is connected to the power input pin of the first linear voltage regulator 203 through the second diode D2 and is grounded through the parallel capacitors C2 and C3. A power output pin of the first linear voltage regulator 203 is connected to the working power output terminal 205. A cathode of the first diode D1 is grounded through the capacitor C1 and is also connected to a CHRG pin of the battery charging management chip 204 through the resistor R3. A PROG pin of the battery charging management chip 204 is grounded through the resistor R2. The resistor R2 is configured for regulating a charging current. When the switching power is used, one way of the power outputted from the switching power supply input terminal 201 charges the rechargeable battery after passing through the battery charging management chip 204, and another way of the power outputted from the switching power supply input terminal 201 passes through the first linear voltage regulator 203 and is thus decreased by the first linear voltage regulator 203 to be outputted as a working power VCC from the working power output terminal 205, thereby supplying power to the whole variable energy lamp control circuit. When the switching power is turned off or the circuit is powered off, the power outputted from the switching power supply input terminal 201 is of 0 volt, at this time, the rechargeable battery supplies power to the first linear voltage regulator 203 through the second diode D2, thus, the rechargeable battery supplies power to the variable energy lamp control circuit of the present disclosure.

Figure 3:
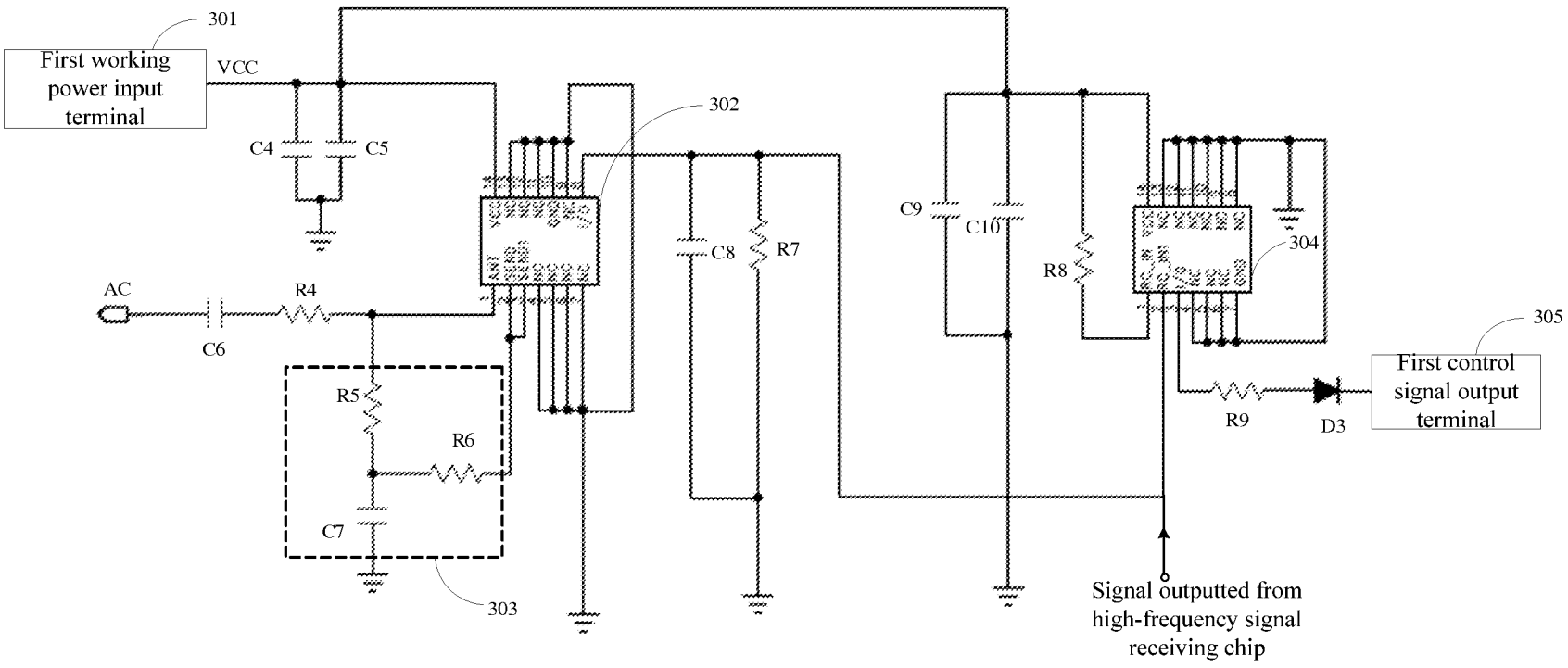
FIG. 3 is a schematic view of an alternating current detection and high-frequency signal transmission circuit of the variable energy lamp control circuit in accordance with an embodiment of the present disclosure.

Referring to FIG. 3, which is a schematic view of the alternating current detection and high-frequency signal transmission circuit, the alternating current detection and high-frequency signal transmission circuit includes a first working power input terminal 301, an alternating current detection and high-frequency transmission chip 302, a first RC network 303, a correction chip 304, a third diode D3, resistors R4, R5, R6, R7, R8, and R9, capacitors C4, C5, C6, C7, C8, C9, and C10, and a first control signal output terminal 305.

The first working power input terminal 301 is connected to the working power output terminal 205 of the power supply management circuit. A power input pin (the fourteenth pin) of the alternating current detection and high-frequency transmission chip 302 is connected to the first working power input terminal 301 and is grounded through the parallel capacitors C4 and C5. A high-frequency signal output pin ANT (the first pin) of the alternating current detection and high-frequency transmission chip 302 is respectively connected to a live wire and a neutral wire (which are labeled as AC in the drawings) through the resistor R4 and the capacitor C6. The resistors R5 and R6 and the capacitor C7 form the first RC network 303. The first RC network 303 is connected between the high-frequency signal output pin ANT (the first pin) and alternating current signal detecting pins SEND (the second pin) and SEND1 (the third pin) of the alternating current detection and high-frequency transmission chip 302. A modulating signal output pin I\O (the eighth pin) of the alternating current signal detection and high-frequency transmission chip 302 is connected to a correction signal input pin RC_IN1 (the second pin) of the correction chip 304. A power input pin of the correction chip 304 is connected to the first working power input terminal 301 and is grounded through the parallel capacitors C9 and C10. A correction signal output pin I\O (the third pin) of the correction chip 304 is connected to an anode of the third diode D3 through the resistor R9, and a cathode of the third diode D3 is connected to the first control signal output terminal 305.

When an alternating current is present in the circuit, the alternating current signal detecting pins SEND and SEND1 (the second and the third pins) of the alternating current detection and high-frequency transmission chip 302 are capable of detecting the alternating current signal. At this time, the high-frequency signal output pin ANT (the first pin) of the alternating current detection and high-frequency transmission chip 302 is turned off, and the modulating signal output pin I\O (the eighth pin) thereof outputs a modulating signal to the correction signal input pin RC_IN1 (the second pin) of the correction chip 304.

When no alternating current is present in the circuit, that is, when the alternating current signal detecting pins SEND and SEND1 (the second and the third pins) of the alternating current detection and high-frequency transmission chip 302 do not detect any alternating current signal, the modulating signal output pin I\O (the eighth pin) of the alternating current detection and high-frequency transmission chip 302 is turned off, meanwhile, the high-frequency signal output pin ANT (the first pin) thereof transmits a high-frequency signal which is further transmitted to the live wire and the neutral wire through the resistors R4 and R6.

The correction chip 304 corrects the signal inputted from the correction signal input pin RC_IN1 (the second pin) to output a high-level signal or a low-level signal to the first control signal output terminal. When the correction signal input pin RC_IN1 (the second pin) of the correction chip 304 receives an electrical signal, the correction signal output pin I\O (the third pin) thereof is turned off. When the correction signal input pin RC_IN1 (the second pin) of the correction chip 304 does not receive any electrical signal, the correction signal output pin I\O (the third pin) thereof outputs a high-level signal.

In the embodiment, when an alternating current is present in the circuit, the signal outputted from the first control signal output terminal 305 is a low-level signal.

Figure 4:
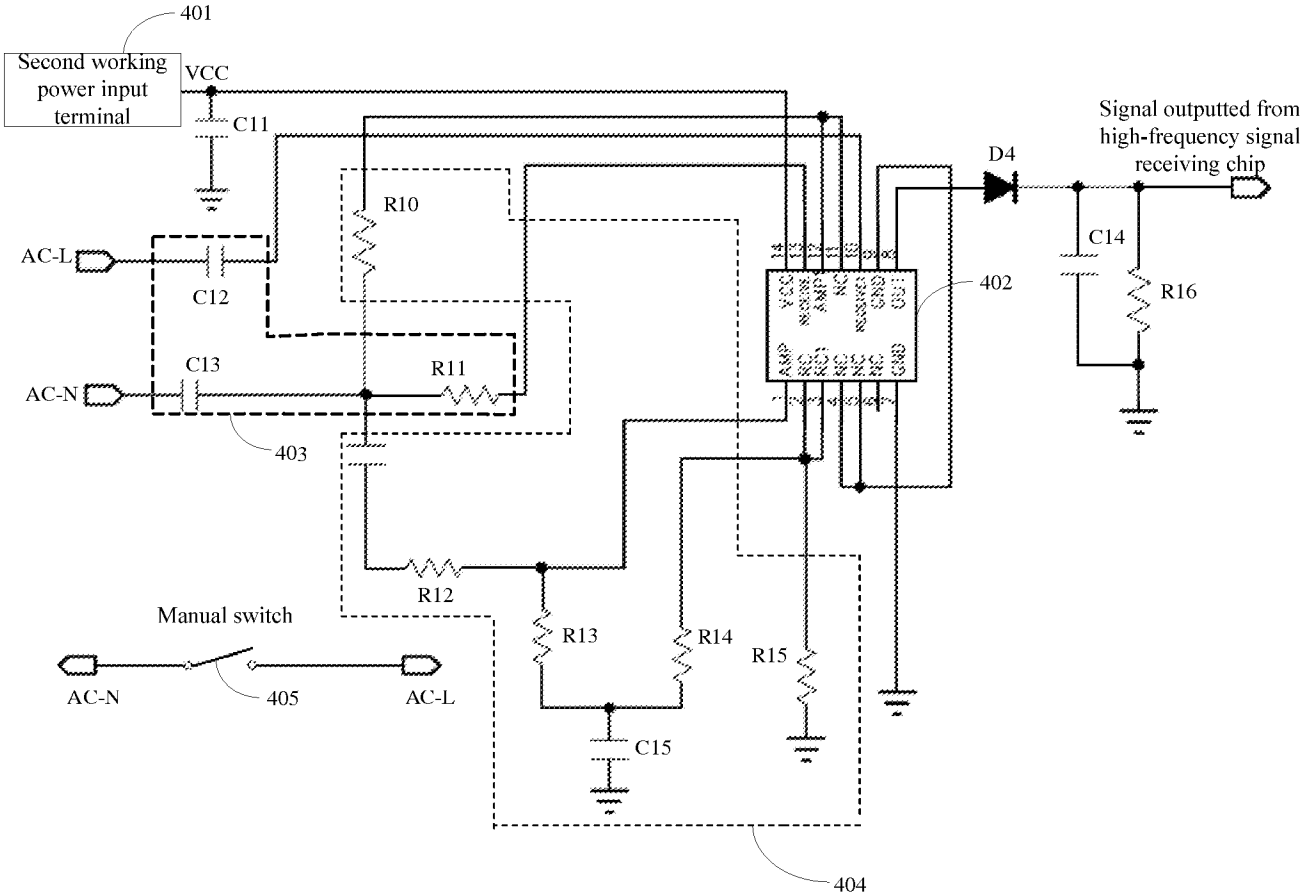
FIG. 4 is a schematic view of a high-frequency signal receiving circuit of the variable energy lamp control circuit in accordance with an embodiment of the present disclosure.

Referring to FIG. 4, which is a schematic view of the high-frequency signal receiving circuit in accordance with an embodiment of the present disclosure, the high-frequency signal receiving circuit includes a second working power input terminal 401, a high-frequency signal receiving chip 402, a second RC network 403, a sampling RC network 404, a fourth diode D4, resistors R10, R11, R12, R13, R14, R15, and R16, capacitors C11, C12, C13, C14, and C15, and a manual switch 405.

As shown, the second RC network 403 is formed by the resistor R11 and the capacitors C12 and C13, the sampling RC network 404 is formed by the resistors R10, R12, R13, R14, and R15 and the capacitor C15. The second RC network 403 and the manual switch 405 are respectively connected to the live wire and the neutral wire.

Specifically, the second working power input terminal 401 is connected to the working power output terminal 205 of the power supply management circuit. A first high-frequency signal input pin RECEIVE1 (the tenth pin) of the high-frequency signal receiving chip 402 is connected to the live wire through the capacitor C12 of the second RC network 403, and a second high-frequency signal input pin RECEIVE (the thirteenth pin) of the high-frequency signal receiving chip 402 is connected to the neutral wire through the resistor R11 and the capacitor C13 of the second RC network 403. Sampling RC network input pins RC (the second pin) and RC1 (the third pin) of the high-frequency signal receiving chip 402 are connected to the sampling RC network 404. A detection output pin OUT (the eighth pin) of the high-frequency signal receiving chip 402 is connected to the correction signal input pin RC_IN1 (the second pin) of the correction chip 304 through the fourth diode D4.

When the high-frequency signal input pins RECEIVE1 (the tenth pin) and RECEIVE (the thirteenth pin) of the high-frequency signal receiving chip 402 simultaneously receive a high-frequency electrical signal, the high-frequency signal receiving chip 402 works and the detection output pin OUT (the eighth pin) thereof outputs a high-level signal which is further transmitted to the correction signal input pin RC_IN1 (the second pin) of the correction chip 304 through the fourth diode D4, the capacitor C14, and the resistor R16 in this order. The detection output pin OUT (the eighth pin) of the high-frequency signal receiving chip 402 outputs a high-level signal only when the high-frequency signal input pins RECEIVE1 (the tenth pin) and RECEIVE (the thirteenth pin) simultaneously receive a high-frequency signal. Thus, the high-frequency signal receiving chip 402 works and the detection output pin OUT (the eighth pin) outputs a high-level signal only when the manual switch 405 is closed. When the manual switch 405 is open, the high-frequency signal receiving chip 402 does not work and the detection output pin OUT (the eighth pin) does not output a high-level signal. That is, when no alternating current is present in the circuit and the manual switch 405 is open, the signal outputted from the first control output terminal 305 is a high-level signal; when no alternating current is present in the circuit and the manual switch 405 is closed, the signal outputted from the first control output terminal 305 is a low-level signal.

Figure 5:
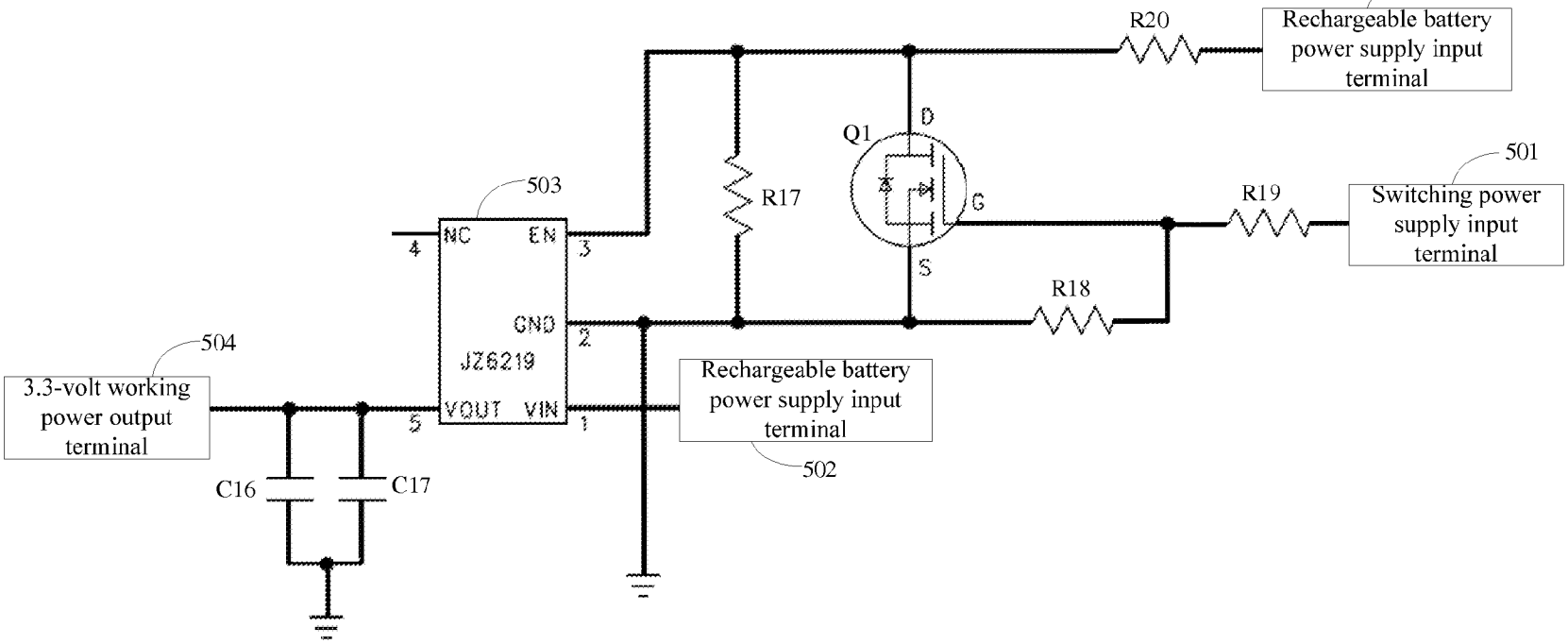
FIG. 5 is a schematic view of a delay circuit working power input control circuit of the variable energy lamp control circuit in accordance with an embodiment of the present disclosure.

Referring to FIG. 5, which is a schematic view of the delay circuit working power input control circuit in accordance with an embodiment of the present disclosure, the delay circuit working power input control circuit includes a switching power supply input terminal 501, a rechargeable battery power supply input terminal 502, a first N-channel Metal-Oxide-Semiconductor Field-Effect Transistor (MOSFET) Q1, a second linear voltage regulator 53, a 3.3-volt working power output terminal 504, a first capacitor C16, a second capacitor C17, and resistors R17, R18, R19, and R20. A power input pin VIN of the second linear voltage regulator 503 is connected to the rechargeable battery power supply input terminal 502, an enable pin EN thereof is connected to the rechargeable battery power supply input terminal 502 through the resistor R20, and a power output pin VOUT thereof is connected to the 3.3-volt working power output terminal 504. The capacitors C16 and C17 are connected in parallel between the power output pin VOUT of the second linear voltage regulator 503 and the ground. A drain D of the first N-channel MOSFET Q1 is connected to the enable pin EN of the second linear voltage regulator 503, a gate G thereof is connected to the switching power supply input terminal 501 through the resistor R19 and is connected to a source S thereof through the resistor R18, and the source S is grounded and is connected to the enable pin EN of the second linear voltage regulator 503 through the resistor R17.

When an alternating current is present in the circuit and the illuminating lamp is turned on, the switching power supply input terminal 501 provides a high-level signal to the gate G of the first N-channel MOSFET Q1, thus, an electrical potential of the drain D is pulled down and the second linear voltage regulator 503 does not work.

When an alternating current is present in the circuit and the illuminating lamp is turned off, the voltage of the switching power supply input terminal 501 is 0 volt, and the rechargeable battery supplies power to the second linear voltage regulator 503 via the power input pin VIN thereof. The rechargeable battery meanwhile supplies power to the enable pin EN and thus the enable pin EN is in a high level. At this time, the second linear voltage regulator 503 outputs a stable voltage of 3.3 volts for supplying a working power of 3.3 volts to the work delay circuit (as shown in FIG. 6).

Figure 6:
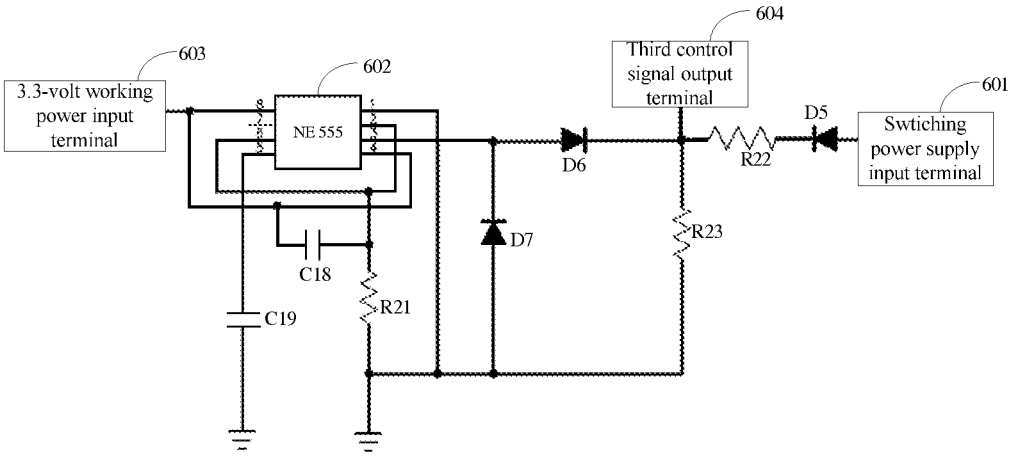
FIG. 6 is a schematic view of a work delay circuit of the variable energy lamp control circuit in accordance with an embodiment of the present disclosure.

Referring to FIG. 6, which is a schematic view of the work delay circuit in accordance with an embodiment of the present disclosure, the work delay circuit includes a switching power supply input terminal 601, a NE 555 clock timing chip 602, a 3.3-volt working power input terminal 603, a third control signal output terminal 604, a fifth diode D5, a sixth diode D6, a seventh diode D7, a third capacitor C18, and a fourth capacitor C19, and resistors R21, R22, and R23.

The 3.3-volt working power input terminal 603 is connected to the 3.3-volt working power output terminal 504 of the delay circuit working power input control circuit. The switching power supply input terminal 601 is connected to an anode of the fifth diode D5, and a cathode of the fifth diode D5 is connected to the third control signal output terminal 604 through the resistor R22 and is connected to a cathode of the sixth diode D6. The cathode of the sixth diode D6 is also grounded through the resistor R23. An anode of the sixth diode D6 is connected to a third pin of the NE 555 clock timing chip 602 and is also connected to a cathode of the seventh diode D7. An anode of the seventh diode D7 is grounded. The 3.3-volt working power input terminal 603 is connected to a fourth and eighth pin of the NE 555 clock timing chip 602. The fourth pin of the NE 555 clock timing chip 602 is also connected to a second pin thereof through the third capacitor C18, a sixth pin thereof is connected to the second pin thereof and is also grounded through the resistor R21, and a fifth pin thereof is grounded through the fourth capacitor C19.

When an alternating current is present in the circuit and the illuminating lamp is turned on, the delay circuit working power input control circuit does not output the working power of 3.3 volts, thus, the NE 555 clock timing chip 602 does not work and the power inputted from the switching power supply input terminal 601 provides a high-level signal to the third control signal output terminal 604 through the fourth diode D5 and the resistor R22.

When an alternating current is present in the circuit and the illuminating lamp is turned off, the voltage inputted from the switching power supply input terminal 601 is of 0 volt, that is, the electrical potential of the third control signal output terminal 604 is in a low level. At this time, the delay circuit working power input control circuit outputs a working power of 3.3 volts to supply power to the NE 555 clock timing chip 602. The NE 555 clock timing chip 602 thus works to charge the capacitor C18. As the voltage of the capacitor C18 increases, the voltages of the second and sixth pins of the NE 555 clock timing chip 602 are gradually decreased. When the voltages are decreased to be two-thirds of VCC, the signal outputted from the third pin of the NE 555 clock timing chip 602 changes from a low level to a high level, and a delay time thereof is determined by the capacitor C18 and the resistor R21. In some embodiments, a capacitance of the capacitor C18 can range from 10 pF to 1000 uF and a resistance of the resistor R21 can range from 2 K to 10 MΩ. Since the delay time of the NE 555 clock timing chip 602 is determined by the capacitor C18 and the resistor R21, thus, the third pin of the NE 555 clock timing chip 602 changes from a low level to a high level after the delay time, and the electrical potential outputted from the third control output terminal 604 changes from a low level to a high level.

Figure 7:
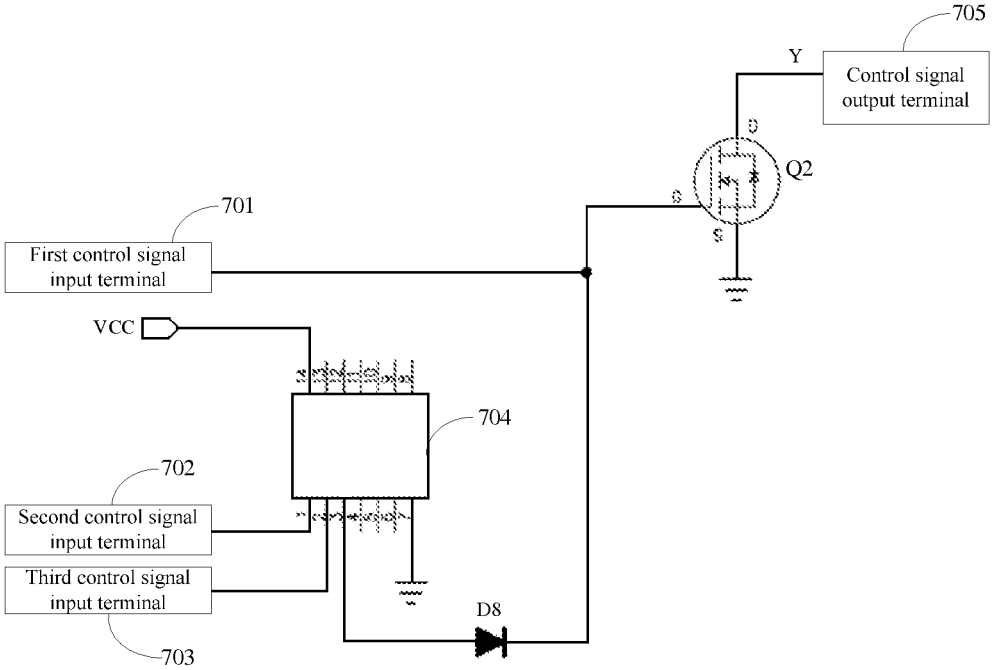
FIG. 7 is a schematic view of a control signal conversion circuit of the variable energy lamp control circuit in accordance with an embodiment of the present disclosure.

Referring to FIG. 7, which is a schematic view of the control signal conversion circuit in accordance with an embodiment of the present disclosure, the control signal conversion circuit includes a first control signal input terminal 701, a second control signal input terminal 702, a third control signal input terminal 703, a two-input AND chip 704, a control signal output terminal 705, an eighth diode D8, and a second N-channel Metal-Oxide-Semiconductor Field-Effect Transistor (MOSFET) Q2. The two-input AND chip 704 includes a first input terminal and a second input terminal.

The first control signal input terminal 701 is connected to the first control signal output terminal 305 of the alternating current detection and high-frequency signal transmission circuit and a gate G of the second N-channel MOSFET Q2. The second control signal input terminal 702 is connected to an output terminal of the alternating current sensing circuit and the first input terminal of the two-input AND chip 704. The third control signal input terminal 703 is connected to the third control signal output terminal 604 of the work delay circuit and the second input terminal of the two-input AND chip 704. An output terminal of the two-input AND chip 704 is connected to an anode of the eighth diode D8, and a cathode of the eighth diode D8 is connected to the gate G of the second N-channel MOSFET Q2. A source S of the second N-channel MOSFET Q2 is grounded, and a drain D thereof is connected to the control signal output terminal 705 and the driving circuit (as shown in FIG. 8).

Figure 8:
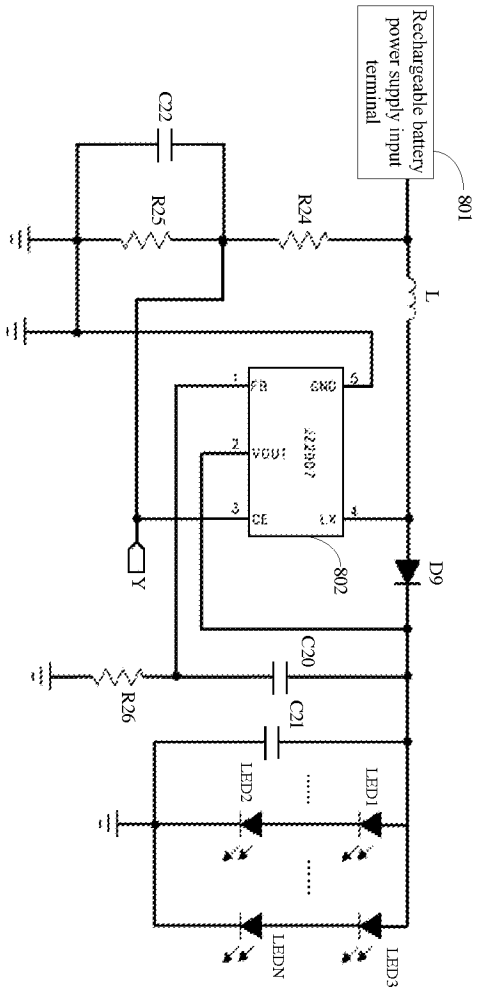
FIG. 8 is a schematic view of a driving circuit of the variable energy lamp control circuit in accordance with an embodiment of the present disclosure.

Referring to FIG. 8, which is a schematic view of the driving circuit in accordance with an embodiment of the present disclosure, the driving circuit includes a rechargeable battery power supply input terminal 801, a driving chip 802, a ninth diode D9, an inductor L, resistors R24, R24, and R26, capacitors C20, 221, and C22. A plurality of variable energy lamps (labeled as LED1-LEDN in the drawings) are connected to the driving circuit. In the embodiment, a model of the driving chip 802 is JZ2007.

The rechargeable battery power supply input terminal 801 is connected to an anode of the ninth diode D9 through the inductor L, and a cathode of the ninth diode D9 is connected to anodes of the corresponding variable energy lamps (LED1, LED3). An enable pin CE of the driving chip 802 is connected to the control signal output terminal 705 of the control signal conversion circuit, and a driving output pin LX of the driving chip 802 is connected to the anodes of the corresponding variable energy lamps (LED1, LED3). Cathodes of the corresponding variable energy lamps (LED1, LEDN) are grounded.

In the embodiment, when an alternating current is present in the circuit and the illuminating lamp is turned on, signals inputted from the second control signal input terminal 702 and the third control signal input terminal 703 are both high-level signals, thus, the output terminal of the two-input AND chip 704 is in a high level. In this case, the gate G of the second N-channel MOSFET Q2 is in a high level, the second N-channel MOSFET Q2 is turned on, and the signal outputted from the control signal output terminal 705 is a low-level signal. Therefore, the driving chip 802 does not work and the variable energy lamps are turned off.

When an alternating current is present in the circuit and the illuminating lamp is turned off, the signal inputted from the first control signal input terminal 701 is a low-level signal, the signal inputted from the second control signal input terminal 702 is a high-level signal, and the signal inputted from the third control signal input terminal 703 is a low-level signal, thus, the gate G of the second N-channel MOSFET Q2 is in a high level, the second N-channel MOSFET Q2 is turned off, and the signal (labeled as Y) outputted from the control signal output terminal is a high-level signal. Therefore, the driving chip 802 works and the variable energy lamps are turned on. When the delay time of the NE 555 clock timing chip 602 is reached, the signal inputted from the third control signal input terminal 703 changes from a low level to a high level, thus, the output terminal of the two-input AND chip 704 is in a high level. In this case, the gate G of the second N-channel MOSFET is in a high level, the second N-channel MOSFET Q2 is turned on, and the signal (labeled as Y in the drawings) outputted from the control signal output terminal 705 is a low-level signal. Therefore, the driving chip 802 does not work and the variable energy lamps change from on to off.

When no alternating current is present in the circuit and the manual switch 405 is closed, the signal inputted from the first control signal input terminal 701 is a low-level signal. Since there is no alternating current in the circuit, the signal inputted from the second control signal input terminal 702 is also a low-level signal. Thus, the output terminal of the two-input AND chip 704 is in a low level. In this case, the gate G of the second N-channel MOSFET Q2 is in a low level, the second N-channel MOSFET Q2 is turned off, and the signal (labeled as Y in the drawings) outputted from the control signal output terminal 705 is a high-level signal. Therefore, the driving chip 802 works and the variable energy lamps are turned on.

When no alternating current is present in the circuit and the manual switch 405 is open, the signal inputted form the first control signal input terminal 701 is a high-level signal. In this case, the gate G of the second N-channel MOSFET Q2 is also in a high level, the second N-channel MOSFET Q2 is turned on, and thus the signal outputted from the control signal output terminal 705 is a low-level signal. Therefore, the driving chip 802 does not work and the variable energy lamps are turned off.

The present disclosure further provides a variable energy lamp control panel includes a variable energy lamp control circuit having a circuitry being the same as what's described above, which is not given in detail hereinafter.

The variable energy lamp control circuit of the present disclosure is capable of controlling the on and off the corresponding variable energy lamp according to the sensing of the alternating current signal in the circuit, the high-frequency signal received by the high-frequency signal receiving circuit, and the working situation of the work delay circuit. When an alternating current is present in the circuit and the illuminating lamp is turned on, the variable energy lamp control circuit is capable of controlling the variable energy lamp to be in an off state; when an alternating current is present in the circuit and the illuminating lamp is turned off, or when no alternating current is present in the circuit, the variable energy lamp control circuit is capable of controlling the variable energy lamp to be in an on state; furthermore, when an alternating current is present in the circuit and the illuminating lamp is turned on, the variable energy lamp control circuit is capable of controlling the variable energy lamp to be in an on state for a predetermined time and thereafter to be in an off state, for realizing emergency lighting; meanwhile, when no alternating current is present in the circuit, the variable energy lamp control circuit of the present disclosure is capable of controlling the on and off the variable energy lamp by the manual switch, allowing the variable energy lamp of the present disclosure to be available in ordinary lighting and emergency lighting and to be used as an early-warning light.

Even though information and the advantages of the present embodiments have been set forth in the foregoing description, together with details of the mechanisms and functions of the present embodiments, the disclosure is illustrative only; and that changes may be made in detail, especially in matters of shape, size, and arrangement of parts within the principles of the present embodiments to the full extend indicated by the broad general meaning of the terms in which the appended claims are expressed.

What is claimed is:

1. A variable energy lamp control circuit, comprising a power supply management circuit, an alternating current detection and high-frequency signal transmission circuit, a manual switch, a high-frequency signal receiving circuit, a delay circuit working power input control circuit, a work delay circuit, an alternating current sensing circuit, a control signal conversion circuit, and a driving circuit;

the power supply management circuit being configured for selecting a way that power is supplied to the variable energy lamp control circuit;

the alternating current detection and high-frequency signal transmission circuit being configured for detecting an outer alternating current signal and transmitting a high-frequency signal according to the alternating current signal;

the high-frequency signal receiving circuit being configured for receiving the high-frequency signal transmitted by the alternating current detection and high-frequency signal transmission circuit when the manual switch is closed;

the alternating current sensing circuit being configured for sensing the outer alternating current signal and outputting a sensing result to the control signal conversion circuit;

the delay circuit working power input control circuit being configured for controlling an input of a working power of the work delay circuit;

the work delay circuit being configured for controlling a delay time of a variable energy lamp from on to off when an alternating current is present in the variable energy lamp control circuit and an illuminating lamp is turned off; and the control signal conversion circuit being configured for controlling on and off of the variable energy lamp via the driving circuit according to whether the circuit is powered on or powered off and whether the manual switch is closed or open and according to the sensing result from the alternating current sensing circuit.

2. The variable energy lamp control circuit of claim 1, wherein when an alternating current is present in the variable energy lamp control circuit and the illuminating lamp is off, the delay circuit working power input control circuit supplies a working power of 3.3 volts to the work delay circuit, thus the work delay circuit works; when an alternating current is present in the variable energy lamp control circuit and the illuminating lamp is on, the delay circuit working power input control circuit does not supply the working power of 3.3 volts to the work delay circuit, thus the work delay circuit does not work.

3. The variable energy lamp control circuit of claim 1, wherein the power supply management circuit comprises a first switching power supply input terminal, a first rechargeable battery power supply input terminal, a battery charging management chip, a working power output terminal, a first linear voltage regulator, a first diode, a second diode, a plurality of resistors and a plurality of capacitors; the first switching power supply input terminal is connected to a power input pin of the battery charging management chip and a power input pin of the first linear voltage regulator through the first diode; the first rechargeable battery power supply terminal is connected to the power input pin of the first linear voltage regulator through the second diode and is grounded through two parallel capacitors; a power output pin of the first linear voltage regulator is connected to the working power output terminal; a cathode of the first diode is grounded through a capacitor and is connected to a charging state indication pin of the battery charging management chip through a resistor; and a charging current setting pin of the battery charging management chip is grounded through a resistor.

4. The variable energy lamp control circuit of claim 3, wherein the alternating current detection and high-frequency signal transmission circuit comprises a first working power input terminal, an alternating current detection and high-frequency transmission chip, a first RC network, a correction chip, a third diode, a first control signal output terminal, and a plurality of resistors and a plurality of capacitors; the first working power input terminal is connected to the working power output terminal of the power supply management circuit; a working power input pin of the alternating current detection and high-frequency transmission chip is connected to the first working power input terminal, a high-frequency signal output pin thereof is respectively connected to a live wire and a neutral wire through a resistor and a capacitor; the first RC network is connected between the high-frequency signal output pin and an alternating current detection pin of the alternating current detection and high-frequency transmission chip, a modulating signal output pin of the alternating current detection and high-frequency transmission chip is connected to a correction signal input pin of the correction chip; a power input pin of the correction chip is connected to the first working input terminal and the correction signal output pin of the correction chip is connected to the first control signal output terminal through a resistor and the third diode.

5. The variable energy lamp control circuit of claim 4, wherein the high-frequency signal receiving circuit comprises a second working power input terminal, a high-frequency signal receiving chip, a second RC network, a sampling RC network a fourth diode, and several resistors and capacitors; the second working power input terminal is connected to the working power output terminal of the power supply management circuit; high-frequency signal input pins of the high-frequency signal receiving chip are respectively connected to the live wire and the neutral wire through the second RC network and a manual switch; a sampling RC network input pin of the high-frequency signal receiving chip is connected to the sampling RC network, and a detection output pin of the high-frequency signal receiving chip is connected to the correction signal input pin of the correction chip through the fourth diode.

6. The variable energy lamp control circuit of claim 5, wherein the delay circuit working power input control circuit comprises a second switching power supply input terminal, a second rechargeable battery power supply input terminal, a 3.3-volt working power output terminal, a first N-channel metal-oxide-semiconductor (MOS) transistor, a second linear voltage regulator, a first capacitor, a second capacitor, and several resistors; a power input pin of the second linear voltage regulator is connected to the rechargeable battery power supply input terminal, an enable pin thereof is connected to the second rechargeable battery power supply input terminal through a resistor, a power output pin thereof is connected to the 3.3-volt working power output terminal and is grounded through the first capacitor and the second capacitor parallel with the first capacitor; a drain of the first N-channel MOS transistor is connected to the enable pin of the second linear voltage regulator, a gate thereof is connected to the second switching power supply input terminal through a resistor and is connected to a source thereof through a resistor, and the source thereof is grounded and is connected to the enable pin of the second linear voltage regulator through a resistor.

7. The variable energy lamp control circuit of claim 6, wherein the work delay circuit comprises a third switching power supply input terminal, a NE 555 clock timing chip, a 3.3-volt working power input terminal, a fifth diode, a sixth diode, a seventh diode, a third capacitor, a fourth capacitor, a third control signal output terminal, and a plurality of resistors; the 3.3-volt working power input terminal is connected to the 3.3-volt working power output terminal, the third switching power supply input terminal is connected to the third control signal output terminal through the fifth diode and a resistor and is connected to a cathode of the sixth diode; an anode of the sixth diode is connected to a third pin of the NE 555 clock timing chip and is connected to a cathode of the seventh diode; an anode of the seventh diode is grounded; the 3.3-volt working power input terminal is connected to a fourth pin and an eighth pin of the NE 555 clock timing chip; the fourth pin of the NE 555 clock timing chip is connected to the second pin thereof through the third capacitor, a sixth pin thereof is connected to the second pin thereof and is grounded through a resistor, and a fifth pin thereof is grounded through the fourth capacitor.

8. The variable energy lamp control circuit of claim 7, wherein the control signal conversion circuit comprises a first control signal input terminal, a second control signal input terminal, a third control signal input terminal, a two-input AND chip, an eighth diode, a second N-channel MOS transistor, and a control signal output terminal; the two-input AND chip comprises a first input terminal and a second input terminal; the first control signal input terminal is connected to a gate of the second N-channel MOS transistor, the second control signal input terminal is connected to an output terminal of the alternating current sensing circuit and is connected to the first input terminal of the two-input AND chip; the third control signal input terminal is connected to the second input terminal of the two-input AND chip; an output terminal of the two-input AND chip is connected to an anode of the eighth diode, and a cathode of the eighth diode is connected to the gate of the second N-channel MOS transistor; a source of the second N-channel MOS transistor is grounded, and a drain thereof is connected to the control signal output terminal.

9. The variable energy lamp control circuit of claim 8, wherein the driving circuit comprises a rechargeable battery power supply input terminal, a driving chip, a ninth diode, an inductor, and several resistors and several capacitors; the variable energy lamp is connected to the driving circuit; an enable pin of the driving chip is connected to the control signal output terminal of the control signal conversion circuit; the rechargeable battery power supply input terminal is connected to an anode of the ninth diode through the inductor, and a cathode of the ninth diode is connected to an anode of the at least one variable energy lamp; a driving output terminal of the driving chip is connected to the anode of the at least one variable energy lamp through the ninth diode, and a cathode of the at least one variable energy lamp is grounded.

10. The variable energy lamp control circuit of claim 9, wherein the alternating current sensing circuit comprises a sensor for sensing the outer alternating current signal.

11. A variable energy lamp control panel, comprising a variable energy lamp control circuit which comprises a power supply management circuit, an alternating current detection and high-frequency signal transmission circuit, a manual switch, a high-frequency signal receiving circuit, a delay circuit working power input control circuit, a work delay circuit, an alternating current sensing circuit, a control signal conversion circuit, and a driving circuit;

the power supply management circuit, being configured for selecting a way that power is supplied to the variable energy lamp control circuit;

the alternating current detection and high-frequency signal transmission circuit being configured for detecting an outer alternating current signal and transmitting a high-frequency signal according to the alternating current signal;

the high-frequency signal receiving circuit being configured for receiving the high-frequency signal transmitted by the alternating current detection and high-frequency signal transmission circuit when the manual switch is closed;

the alternating current sensing circuit being configured for sensing the outer alternating current signal and outputting a sensing result to the control signal conversion circuit;

the delay circuit working power input control circuit being configured for controlling an input of a working power of the work delay circuit;

the work delay circuit being configured for controlling a delay time of a variable energy lamp from on to off when an alternating current is present in the variable energy lamp control circuit and an illuminating lamp is turned off; and the control signal conversion circuit being configured for controlling the on and off of the variable energy lamp via the driving circuit according to whether the variable energy lamp control circuit is powered on or powered off and according to whether the manual switch is closed or open and according to the sensing result from the alternating current sensing circuit.

12. The variable energy lamp control panel of claim 11, wherein when an alternating current is present in the variable energy lamp control circuit and the illuminating lamp is off, the delay circuit working power input control circuit supplies a working power of 3.3 volts to the work delay circuit, thus the work delay circuit works; when an alternating current is present in the variable energy lamp control circuit and the illuminating lamp is on, the delay circuit working power input control circuit does not provide the working power of 3.3 volts to the work delay circuit, thus the work delay circuit does not work.

13. The variable energy lamp control panel of claim 11, wherein the power supply management circuit comprises a first switching power supply input terminal, a rechargeable battery power supply input terminal, a battery charging management chip, a working power output terminal, a first linear voltage regulator, a first diode, a second diode, several resistors and several capacitors; the first switching power supply input terminal is connected to a power input pin of the battery charging management chip and a power input pin of the first linear voltage regulator through the first diode; the rechargeable battery power supply terminal is connected to the power input pin of the first linear voltage regulator through the second diode and is grounded through two parallel capacitors; a power output pin of the first linear voltage regulator is connected to the working power output terminal; a cathode of the first diode is grounded through a capacitor and is connected to a charging state indication pin of the battery charging management chip through a resistor; and a charging current setting pin of the battery charging management chip is grounded through a resistor.

14. The variable energy lamp control panel of claim 13, wherein the alternating current detection and high-frequency signal transmission circuit comprises a first working power input terminal, an alternating current detection and high-frequency transmission chip, a first RC network, a correction chip, a third diode, a first control signal output terminal, and several resistors and capacitors; the first working power input terminal is connected to the working power output terminal of the power supply management circuit; a working power input pin of the alternating current detection and high-frequency transmission chip is connected to the first working power input terminal, a high-frequency signal output pin thereof is connected to a live wire and a neutral wire respectively through a resistor and a capacitor; the first RC network is connected between the high-frequency signal output pin and an alternating current detection pin of the alternating current detection and high-frequency transmission chip, a modulating signal output pin of the alternating current detection and high-frequency transmission chip is connected to a correction signal input pin of the correction chip; a power input pin of the correction chip is connected to the first working input terminal and the correction signal output pin of the correction chip is connected to the first control signal output terminal through a resistor and the third diode.

15. The variable energy lamp control panel of claim 14, wherein the high-frequency signal receiving circuit comprises a second working power input terminal, a high-frequency signal receiving chip, a second RC network, a sampling RC network a fourth diode, and several resistors and capacitors; the second working power input terminal is connected to the working power output terminal of the power supply management circuit; high-frequency signal input pins of the high-frequency signal receiving chip are respectively connected to the live wire and the neutral wire through the second RC network and a manual switch; a sampling RC network input pin of the high-frequency signal receiving chip is connected to the sampling RC network, and a detection output pin of the high-frequency signal receiving chip is connected to the correction signal input pin of the correction chip through the fourth diode.

16. The variable energy lamp control panel of claim 15, wherein the delay circuit working power input control circuit comprises a second switching power supply input terminal, a battery charging management input terminal, a 3.3-volt working power output terminal, a first N-channel metal-oxide-semiconductor (MOS) transistor, a second linear voltage regulator, a first capacitor, a second capacitor, and several resistors; a power input pin of the second linear voltage regulator is connected to the rechargeable battery power supply input terminal, an enable pin thereof is connected to rechargeable battery power supply input terminal through a resistor, a power output pin thereof is connected to the 3.3-volt working power output terminal and is grounded through the first capacitor and the second capacitor parallel with the first capacitor; a drain of the first N-channel MOS transistor is connected to the enable pin of the second linear voltage regulator, a gate thereof is connected to the second switching power supply input terminal through a resistor and is connected to a source thereof through a resistor, and the source thereof is grounded and is connected to the enable pin of the second linear voltage regulator through a resistor.

17. The variable energy lamp control panel of claim 16, wherein the work delay circuit comprises a third switching power supply input terminal, a NE 555 clock timing chip, a 3.3-volt working power input terminal, a fifth diode, a sixth diode, a seventh diode, a third capacitor, a fourth capacitor, a third control signal output terminal, and several resistors; the 3.3-volt working power input terminal is connected to the 3.3-volt working power output terminal, the third switching power supply input terminal is connected to the third control signal output terminal through the fifth diode and a resistor and is connected to a cathode of the sixth diode; an anode of the sixth diode is connected to a third pin of the NE 555 clock timing chip and is connected to a cathode of the seventh diode; an anode of the seventh diode is grounded; the 3.3-volt working power input terminal is connected to a fourth pin and an eighth pin of the NE 555 clock timing chip; the fourth pin of the NE 555 clock timing chip is connected to the second pin thereof through the third capacitor, a sixth pin thereof is connected to the second pin thereof and is grounded through a resistor, and a fifth pin thereof is grounded through the fourth capacitor.

18. The variable energy lamp control panel of claim 17, wherein the control signal conversion circuit comprises a first control signal input terminal, a second control signal input terminal, a third control signal input terminal, a two-input AND chip, an eighth diode, a second N-channel MOS transistor, and a control signal output terminal; the two-input AND chip comprises a first input terminal and a second input terminal; the first control signal input terminal is connected to a gate of the second N-channel MOS transistor, the second control signal input terminal is connected to an output terminal of the alternating current sensing circuit and is connected to the first input terminal of the two-input AND chip; the third control signal input terminal is connected to the second input terminal of the two-input AND chip; an output terminal of the two-input AND chip is connected to an anode of the eighth diode, and a cathode of the eighth diode is connected to the gate of the second N-channel MOS transistor; a source of the second N-channel MOS transistor is grounded, and a drain thereof is connected to the control signal output terminal.

19. The variable energy lamp control panel of claim 18, wherein the driving circuit comprises a rechargeable battery power supply input terminal, a driving chip, a ninth diode, an inductor, and several resistors and several capacitors; the variable energy lamp is connected to the driving circuit; an enable pin of the driving chip is connected to the control signal output terminal of the control signal conversion circuit; the rechargeable battery power supply input terminal is connected to an anode of the ninth diode through the inductor, and a cathode of the ninth diode is connected to an anode of the at least one variable energy lamp; a driving output terminal of the driving chip is connected to the anode of the at least one variable energy lamp through the ninth diode, and a cathode of the at least one variable energy lamp is grounded.

20. The variable energy lamp control panel of claim 19, wherein the alternating current sensing circuit comprises a sensor for sensing the outer alternating current signal.

* * * * *